US008151878B2

(12) United States Patent
Georgi et al.

(10) Patent No.: US 8,151,878 B2
(45) Date of Patent: Apr. 10, 2012

(54) APPARATUS AND METHODS FOR COLLECTING A DOWNHOLE SAMPLE

(75) Inventors: Daniel T. Georgi, Houston, TX (US); Andrew D. Kirkwood, Houston, TX (US); Roger W. Fincher, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 719 days.

(21) Appl. No.: 12/255,888

(22) Filed: Oct. 22, 2008

(65) Prior Publication Data

US 2010/0095758 A1 Apr. 22, 2010

(51) Int. Cl.
*E21B 49/08* (2006.01)

(52) U.S. Cl. ..... 166/264; 73/152.28

(58) Field of Classification Search ..... 73/152.11, 73/152.23–152.28; 166/264, 313
See application file for complete search history.

(56) References Cited

U.S. PATENT DOCUMENTS 3,327,781 A * 6/1967 Nutter ..... 166/264
4,222,438 A * 9/1980 Hollingsworth et al. ..... 166/264
4,790,378 A * 12/1988 Montgomery et al. ..... 166/66
5,246,070 A * 9/1993 Greve et al. ..... 166/242.3
5,289,875 A * 3/1994 Stokley et al. ..... 166/264
5,485,881 A 1/1996 Toon et al.
5,934,374 A 8/1999 Hrametz et al.
6,062,073 A * 5/2000 Patton et al. ..... 73/152.28
6,305,482 B1 10/2001 Aumann et al.
6,378,631 B1 4/2002 Aumann et al.
6,659,204 B2 12/2003 Aumann et al.
6,688,390 B2 2/2004 Bolze et al.
7,062,958 B2 6/2006 Diakonov et al.
7,168,508 B2 1/2007 Goldberg et al.
2007/0205021 A1 9/2007 Pelletier et al.
2009/0241658 A1 * 10/2009 Irani et al. ..... 73/152.23

OTHER PUBLICATIONS

Brian F. Towler, et al. "Reservoir Engineering Aspects of Bottomhole Sampling of Saturated Oils for PVT Analysis". SPE 19438-MS. 1989.
Bon, et al. "Reservoir-Fluid Sampling Revisted-A Practical Perspective". SPE reservoir Evaluation & Engineering. Dec. 2007. pp. 589-596.
Nagarajan, N. R. "Reservoir-Fluid Sampling and Characterization-Key to Efficient Reservoir Management". Society of Petroleum Engineers. SPE 103501. JPT. Aug. 2007. pp. 80-91.
Bon, et al. "Reservoir Fluid Sampling Revisited-A Practical Perspective". SPE 10137. 2006 SPE Asia Pacific Oil and Gas Conference and Exhibition held in Adelaide, Australia, Sep. 11-13, 2006.
Williams, John M. "Getting the Best out of Fluid Samples". SPE. Science Support Services. Sep. 1994. JPT.
International Search Report and Written Opinion, Mailed May 28, 2010, International Appln. No. PCT/US2009/061008, Written Opinion 3 Pages, International Search Report 7 Pages.

* cited by examiner

*Primary Examiner* — John Fitzgerald
(74) *Attorney, Agent, or Firm* — Cantor Colburn LLP

(57) ABSTRACT

Methods and apparatus for collecting a downhole sample are provided. The method may include conveying a sampling tool in a borehole using a first carrier, conveying a sample container in the borehole using a second carrier, and introducing a downhole sample from the sampling tool to the sample container. An apparatus includes a sampling tool disposed on a first carrier, a sample container disposed on a second carrier, wherein the first carrier and the second carrier are independently conveyable in a borehole, and a coupling connectable to the sampling tool and the sample container.

18 Claims, 4 Drawing Sheets

APPARATUS AND METHODS FOR COLLECTING A DOWNHOLE SAMPLE

BACKGROUND

1. Technical Field

The present disclosure generally relates to downhole tools and in particular to methods and apparatus for collecting a downhole sample.

2. Background Information

Oil and gas wells have been drilled at depths ranging from a few hundred feet to as deep as 5 miles. Wireline and drilling tools often incorporate various sensors, instruments and control devices in order to carry out any number of downhole operations. These operations may include formation testing and monitoring and tool monitoring and control.

Formation testing tools have been used for monitoring formation pressures along well boreholes, obtaining formation fluid samples, and predicting performance of reservoirs. Such formation testing tools typically contain an elongated body having an elastomeric packer and/or pad that is sealingly pressed against a zone of interest in the borehole to collect formation fluid samples in fluid receiving chambers placed in the tool.

Often the fluid receiving chambers become contaminated with drilling mud, formation fluids from prior sampling, water, and other contaminants. There is also difficulty encountered in measuring samples to accurately estimate a downhole fluid property. For example, downhole fluids can be unstable and/or the downhole tools can provide inaccurate results. There is a need, therefore, for improved apparatus and methods for reducing the potential for drilling fluid and other impurities from contaminating downhole sample chambers and/or acquiring more accurate estimations of one or more downhole fluid properties.

SUMMARY

The following presents a general summary of several aspects of the disclosure in order to provide a basic understanding of at least some aspects of the disclosure. This summary is not an extensive overview of the disclosure. It is not intended to identify key or critical elements of the disclosure or to delineate the scope of the claims. The following summary merely presents some concepts of the disclosure in a general form as a prelude to the more detailed description that follows.

Disclosed is a method for collecting a downhole sample that includes conveying a sampling tool in a borehole using a first carrier, conveying a fluid sample container in the borehole using a second carrier, and introducing a downhole sample from the sampling tool to the sample container.

Another method disclosed for collecting a downhole sample includes conveying a sampling tool in a borehole using a first carrier, engaging a downhole formation zone using the sampling tool, conveying a sample container proximate the location of the sample tool using a second carrier, mating the sample container to the sample tool, introducing a downhole sample from the sample tool to the sample container, and retrieving the sample container from the borehole.

Another aspect disclosed is an apparatus for collecting a downhole sample that includes a sampling tool disposed on a first carrier, a sample container disposed on a second carrier, wherein the first carrier and the second carrier are independently conveyable in a borehole, and a coupling connectable to the sampling tool and the sample container.

BRIEF DESCRIPTION OF THE DRAWINGS

For a detailed understanding of the present disclosure, reference should be made to the following detailed description of the several non-limiting embodiments, taken in conjunction with the accompanying drawings, in which like elements have been given like numerals and wherein.

DESCRIPTION OF EXEMPLARY EMBODIMENTS

Figure 1:
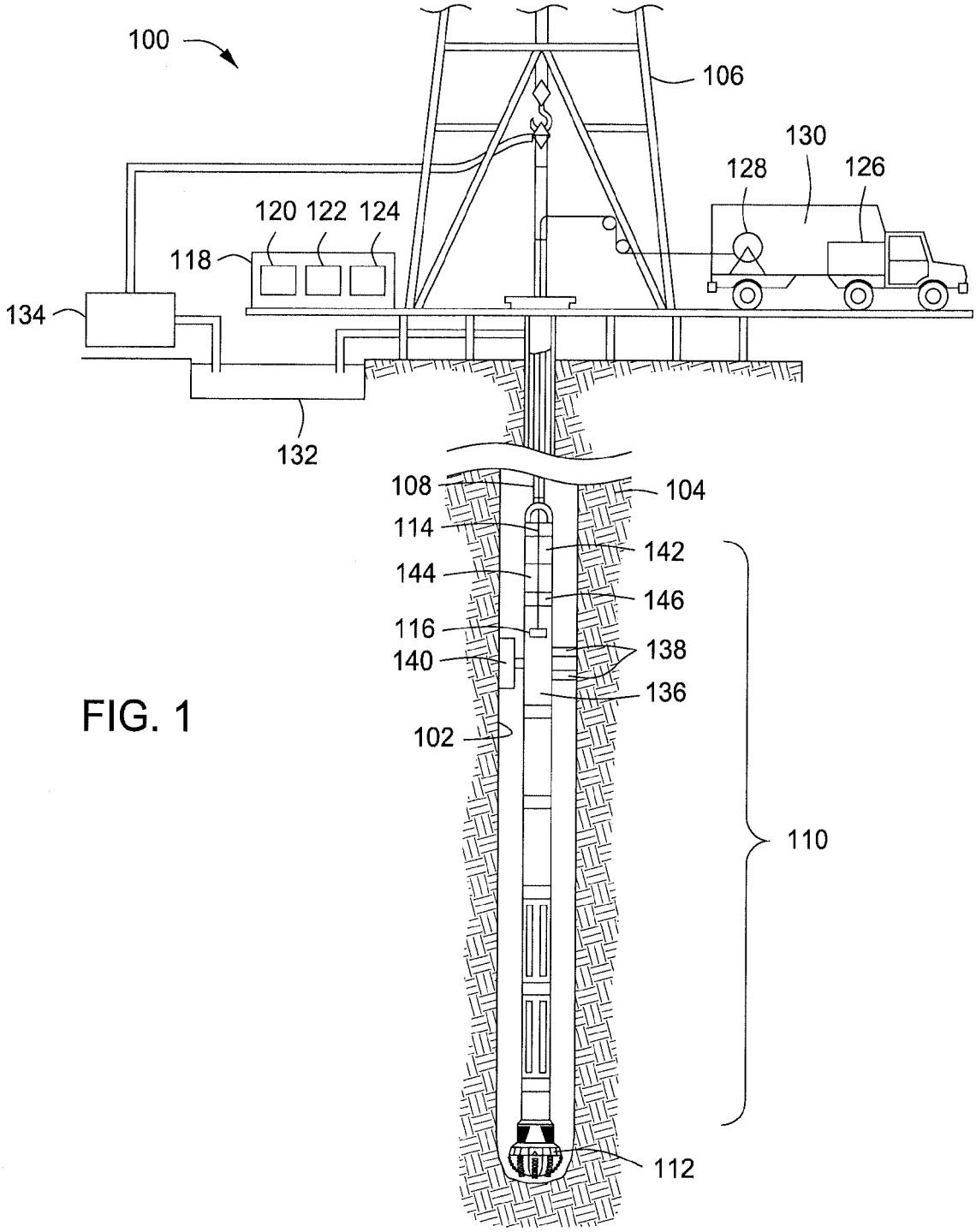
FIG. 1 illustrates a non-limiting example of a while-drilling system according to the disclosure.

FIG. 1 schematically illustrates a non-limiting example of a while-drilling system 100 in a measurement-while-drilling ("MWD") arrangement according to several non-limiting embodiments of the disclosure. The while-drilling system 100 is shown disposed in a well borehole 102 penetrating earth formations 104. The borehole 102 can be filled with a fluid having a density sufficient to prevent formation fluid influx. In one or more embodiments, the borehole 102 may be a reinforced borehole. For example, the borehole 102 can be reinforced with cement, a casing, or both. Reinforcing the borehole 102 can support the borehole and prevent formation fluid influx into the borehole 102.

A derrick 106 supports a first carrier or ("drill string") 108, which may be a coiled tube or drill pipe. The drill string 108 may carry a bottom hole assembly ("BHA") referred to as a downhole sub 110 and a drill bit 112 at a distal end of the drill string 108 for drilling the borehole 102 through the earth formations 104. The downhole sub 110 includes a downhole tool 136, an electrical power section 142, an electronics section 144, and a mechanical power section 146. The while-drilling system 100 also includes a second carrier or ("slickline") 114 that may be used to carry one or more sample containers 116 to a position proximate the downhole sub 110. As illustrated the slickline 114 can be spooled and unspooled from a winch or drum 128. The winch or drum 128 may be disposed on a truck 130. In several non-limiting embodiments the slickline 114 may be conveyed into the borehole 102 within the drill string 108. In other non-limiting embodiments the slickline 114 may be conveyed directly into the borehole 102, for example between the annulus of the borehole wall and the drill string 108.

The exemplary downhole sub 110 disposed on the drill string 108 and the slickline 114 operate as carriers, but any carrier is considered within the scope of the disclosure. The term "carrier" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof Other carrier examples include casing strings, wirelines, wireline sondes, slicklines, slickline sondes, drop shots, downhole subs, BHAs, drill string inserts, modules, internal housings and substrate portions thereof.

The downhole sub 110 may be configured to convey information signals to a first set of surface equipment 118 by an electrical conductor and/or an optical fiber (not shown) disposed within the drill string 108. The surface equipment 118 can include one part of a telemetry system 120 for communicating control signals and data signals to the downhole sub 110 and may further include a computer 122. The surface equipment 118 can also include a data recorder 124 for recording measurements acquired by the downhole sub 110 and transmitted to the surface equipment 118.

The slickline 114 may be configured to convey information signals to a second set of surface equipment 126 by an electrical conductor and/or an optical fiber (not shown). The second set of surface equipment 126 may be substantially similar to the first set of surface equipment 118. In several non-limiting embodiments the first set of surface equipment 118 and the second set of surface equipment 126 may be a single set of surface equipment. In other non-limiting embodiments the first set of surface equipment 118 and the second set of surface equipment 126 may be combined within a single unit or housing.

Drilling operations according to several embodiments may include pumping a drilling fluid or "mud" from a mud pit 132 using a circulation system 134 and circulating the mud through an inner bore or ("drilling fluid flow line") of the drill string 108. The mud exits at the drill bit 112 and returns to the surface through an annular space between the drill string 108 and inner wall of the borehole 102. The drilling fluid may provide hydrostatic pressure that is greater than the formation pressure to avoid blowouts. The pressurized drilling fluid may further be used to drive a drilling motor 130 and may provide lubrication to various elements of the drill string 108 and/or the slickline 114.

In one or more embodiments, the one or more sample containers 116 disposed on the slickline 114 may be pumped within the inner bore of the drill string 108 to a location proximate the downhole sub 110. In one non-limiting embodiment the one or more sample containers 116 may be pumped to a position proximate a downhole tool 136 disposed on the downhole sub 110. In several non-limiting embodiments the one or more sample containers 116 may be pumped through at least a portion of the drilling fluid flow line disposed within the drill string 108. In one non-limiting embodiment the drilling fluid or mud from the mud pit 132 may be used to pump the one or more sample containers 116 to a position proximate the downhole tool 136. In one or more embodiments, the one or more sample containers 116 disposed on the slickline 114 may be conveyed to a position proximate the one or more sample containers 116 using gravity alone.

The exemplary downhole sub 110 may be urged toward a side of the borehole 102 using one or more extendable members 138. In other non-limiting examples the downhole sub 110 may be centered within the borehole 102 by one or more centralizers, for example a top centralizer and a bottom centralizer, attached to the downhole sub 110 at axially spaced apart locations. The centralizers can be of any suitable type known in the art such as bowsprings, inflatable packers, and/or rigid vanes.

The downhole sub 110 of FIG. 1 illustrates a non-limiting example of a while-drilling system 100 for collecting one or more downhole samples, along with several examples of supporting functions that may be included on the downhole sub 110. In several non-limiting embodiments the downhole tool 136 disposed on the downhole sub 110 may retrieve a downhole sample and the one or more sample containers 116 disposed on the slickline 114 may contain and convey the downhole sample to the surface. In one or more embodiments, the downhole tool 136 may estimate one or more properties of a downhole sample prior to introducing the downhole sample to the sample container 116.

In one or more embodiments, the downhole tool 136 may include a downhole sample extraction tool. In one or more embodiments, the sample extraction tool may include an extendable probe 140 that is opposed by the one or more extendable members 138. The extendable probe 140 may include a sample port for receiving a downhole sample. The downhole sample may be a solid, liquid, gas, or any combination thereof In one non-limiting embodiment the downhole sample may include a core sample extracted from a borehole sidewall or from the borehole bottom. In another non-limiting embodiment the downhole sample may include a formation fluid sample. In another non-limiting embodiment the downhole sample may include a borehole fluid sample, for example return drilling fluid.

The extensible probe 140, the one or more extendable members 138, or both may be hydraulically, pneumatically, or electro-mechanically extendable to firmly engage an inner wall of the borehole 102. In another non-limiting embodiment, the probe 140 may be non-extensible, where the one or more extendable members 138 may urge a sample port disposed on the probe 140 toward the inner wall of the borehole 102. In one non-limiting embodiment the downhole tool 136 may include a tool suitable for forming a hole through a reinforced borehole wall to provide fluid communication between the probe 140 and the formation 104. In several non-limiting embodiments one or more sample containers may be included on the sample container 116 for retaining downhole samples recovered from the extendable probe 140.

In one non-limiting embodiment, the downhole tool 136 may be used to estimate one or more downhole sample properties. In several non-limiting embodiments, the downhole tool 136 may introduce one or more downhole samples to the sample container 116. Downhole samples introduced to the sample container 116 may be retrieved to the surface for one or more downhole sample property estimations performed at the surface. The sample container 116 may be or include one or more other devices, such as coolers, pressure controllers, etc. without departing from the scope of the disclosure. The downhole tool 136 and the sample container 116 may be coupled together using a suitable coupler. Coupling the sample extraction tool and the sample container may provide fluid communication between the sample extraction tool and sample container. Coupling the fluid extraction tool and the sample container can provide a transfer path for one or more downhole samples to be conveyed from the downhole tool 136 sample extraction tool to the sample container 116.

The one or more downhole sample property estimations may be performed on any type of downhole sample whether solid, liquid, gas, or a combination thereof Illustrative downhole properties that may be estimated can include, but are not limited to a temperature, pressure, chemical composition, bubble point pressure, viscosity, electrical resistivity, flow rate, density, pH, optical properties, magnetic susceptibility, dielectric, and formation permeability.

The electrical power section 142 can receive or generate, depending on the particular tool configuration, electrical power for the downhole sub 110. In the case of a while-drilling tool configuration as shown in this example, the electrical power section 142 may include a power generating device such as a mud turbine generator, a battery module, or other suitable downhole electrical power generating device. In the case of a wireline configuration, the electrical power section 142 may include a power swivel that is connected to the wireline power cable 106. In some examples, wireline tools may include power generating devices and while-drilling tools may utilize wired pipes for receiving electrical power and communication signals from the surface. The electrical power section 142 may be electrically coupled to any number of downhole tools and to any of the components in the downhole sub 110 requiring electrical power. The electrical power section 142 in the example shown provides electrical power to the electronics section 144.

The electronics section 144 may include any number of electrical components for facilitating downhole tests, information processing, and/or storage. In some non-limiting examples, the electronics section 144 includes a processing system that includes at least one information processor. The processing system may be any suitable processor-based control system suitable for downhole applications and may utilize several processors depending on how many other processor-based applications are to be included in the downhole sub 110. The processor system can include a memory unit for storing programs and information processed using the processor, transmitter and receiver circuits may be included for transmitting and receiving information, signal conditioning circuits, and any other electrical component suitable for the downhole sub 110 may be housed within the electronics section 144.

A power bus may be used to communicate electrical power from the electrical power section 142 to the several components and circuits housed within the electronics section 144 and/or the mechanical power section. A data bus may be used to communicate information between the mandrel section 130 and the processing system included in the electronics section 144, and between the electronics section 144 and the telemetry system 120. The electrical power section 142 and electronics section 144 may be used to provide power and control information to the mechanical power section 146 where the mechanical power section 146 includes electromechanical devices. Some electronic components may include added cooling, radiation hardening, vibration and impact protection, potting and other packaging details that do not require in-depth discussion here. Processor manufacturers that produce information processors suitable for downhole applications include Intel, Motorola, AMD, Toshiba, and others. In wireline applications, the electronics section 144 may be limited to transmitter and receiver circuits to convey information to a surface controller and to receive information from the surface controller via a wireline communication cable.

In the non-limiting example of FIG. 1, the mechanical power section 146 may be configured to include any number of power generating devices to provide mechanical power and force application for use by the downhole tool 136. The power generating device or devices may include one or more of a hydraulic unit, a mechanical power unit, an electromechanical power unit, or any other unit suitable for generating mechanical power for the one or more downhole tools 136 and other not-shown devices requiring mechanical power.

In several non-limiting examples, the one or more downhole tools 136 and/or sample containers 116 may utilize mechanical power from the mechanical power section 146 and may also receive electrical power from the electrical power section 142. Control of the one or more downhole tools 136, sample containers 116 and other devices on the downhole sub 110 may be provided by the electronics section 144 or by a controller disposed on the downhole sub 110. In some embodiments, the power and controller may be used for orienting the one or more downhole tools 136 within the borehole 102. The one or more downhole tools 136 can be configured as a rotating sub that rotates about and with respect to the longitudinal axis of the downhole sub 110. In other examples, the one or more downhole tools 136 may be oriented by rotating the downhole sub 110 and the downhole tools together. The electrical power from the electrical power section 142, control electronics in the electronics section 144, and mechanical power from the mechanical power section 146 may be in communication with the one or more downhole tools 136 to power and control the downhole tools.

Figure 2:
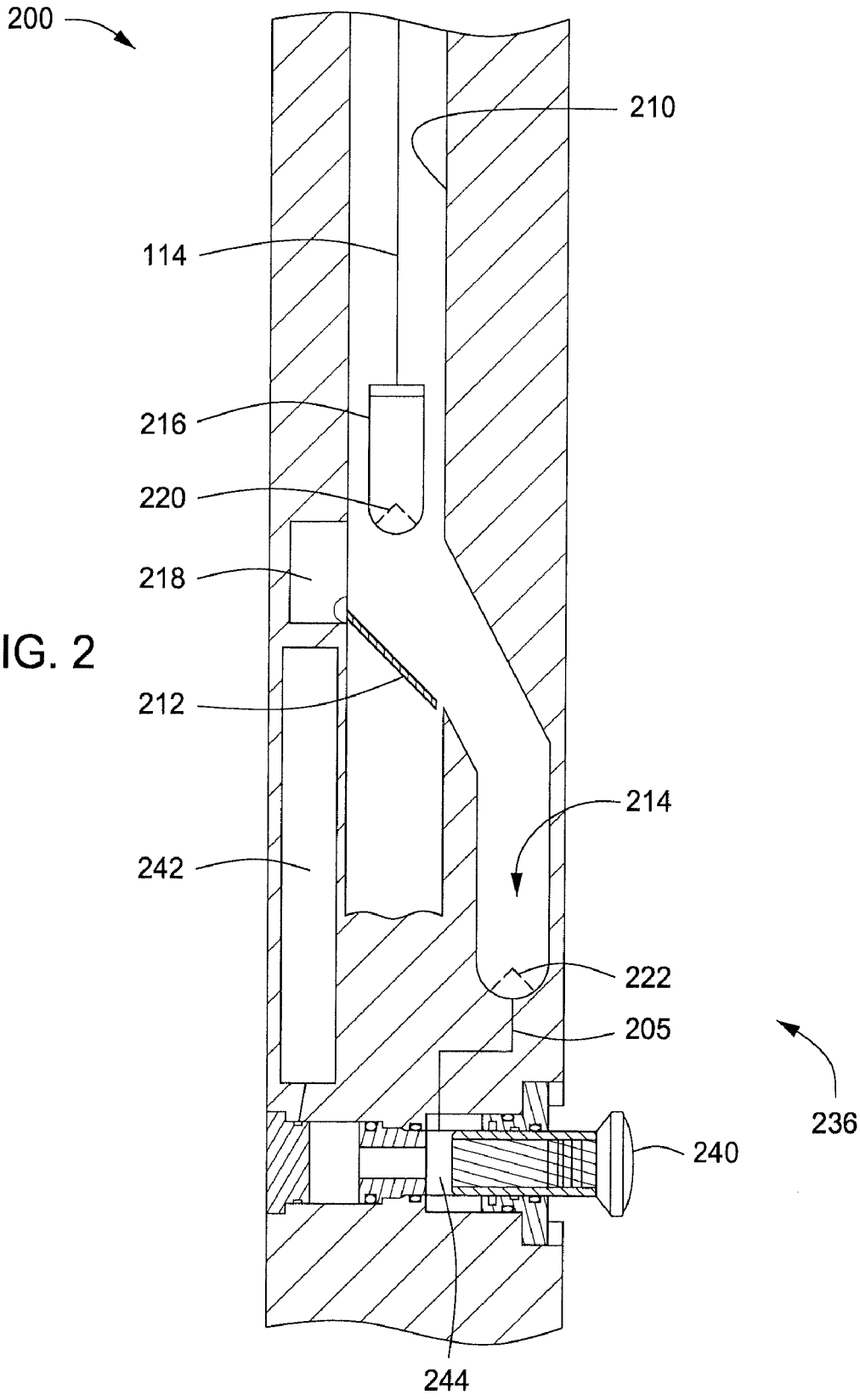
FIG. 2 illustrates a partial cross-sectional view of a downhole sub according to the disclosure.

FIG. 2 illustrates a partial cross-sectional view of a downhole sub 200 according to the disclosure. In one or more embodiments, the downhole sub 200 may include a downhole tool 236 and a sample container 216, which may be substantially similar to the one or more downhole tools 136, sample containers 116 discussed above and shown in FIG. 1. In one or more embodiments, the downhole tool 236 may include an extendable sample probe 240 for retrieving one or more downhole samples. The extendable sample probe 240 may be operated by a motor 242. Those skilled in the art with the benefit of this disclosure will recognize that any suitable downhole tool may be used without departing from the scope of this disclosure.

In one non-limiting embodiment the sample container 216 may be conveyed to the downhole tool 236 through a path 210 disposed within at least a portion of the downhole tool 236. In one or more embodiments, the path 210 may be a drilling fluid flow line disposed through a drill string. In another non-limiting embodiment the path 210 may be a path dedicated for the sample container 216 and/or other downhole tools. The sample container 216 may be conveyed to the downhole tool 236 by pumping the sample container 216 through the path 210, by gravity, or by a combination thereof.

Any suitable fluid may be used to convey the sample container 216 through the drill string 108. For example drilling fluid, drilling mud, and the like. In one non-limiting embodiment the sample container 216 may be conveyed to the downhole tool 236 using gravity alone. In other non-limiting embodiments a gas, for example air, may be compressed and introduced into the path 210 behind the sample container 216. The gas can convey the sample container 216 through the path 210. In one non-limiting embodiment the sample container 216 may include one or more O-rings disposed about a perimeter, which may improve transport of the sample container 216 through the path 210.

As illustrated in the non-limiting embodiment shown in FIG. 2, a path control body 212 may operate to divert the sample container 216 from a drilling fluid flow line 210 toward a mating section 214. The path control body 212 may be operated and controlled by a path control motor 218. The path control motor 218 may rotate, slide, extend, or otherwise position the path control body 212 within the path 210 to direct the sample container 216 toward the mating section 214. The path control mechanism 212 may completely or partially block the path 210 in order to direct the sample container 216 toward the mating section 214.

In one or more embodiments, the path control body 212 may be a sold member that can completely seal off the path 210. In another non-limiting embodiment the path control body 212 may include one or more holes, apertures, perforations, grooves about its perimeter, and the like that may permit at least a portion of a fluid used to convey the sample container 214 through the path 210 to flow through and/or around the path control body 212. In one or more embodiments, the path control body 212 may include an inflatable member similar to a downhole packer that may be inflated within the path 210 to direct the sample container 216 toward the mating section 214. In this example the path control motor 218 may include a compressor or pump that can introduce a pressurized fluid into the inflatable member.

The sample container 216 may include a first connector 220. The first connector 220 may be adapted to connect, mate, couple, or otherwise engage with a second connector 222 disposed on the downhole tool 236. The first connector 220 and the second connector 222 may be complimentary connectors. For example, the first connector 220 may include a hole or depression formed in the sample container 216 which may receive a complimentary protrusion or projection disposed on the downhole tool 236. In one or more embodiments, the connectors 220, 222 may include a fluid coupling to provide fluid communication between the sample container 216 and the downhole tool 236. In one or more embodiments, the connectors 220, 222 may include electrical conductors that are also in communication with the slick-line 114 and/or with other conductors leading to a controller to provide communication and control capability for the sample container 216 and/or the downhole tool 236. The first connector 220 and the second connector 222, when mated or otherwise engaged may provide a coupling between the downhole tool 236 and the sample container 216. The first connector 220 and the second connector 222 may couple the sample container 216 and the downhole tool 220 together. The complimentary connectors 220, 222 may provide a quick connection between the sample container 216 and the downhole tool 236. The connectors may be threaded connectors, plug-type connectors, press fit, snap fit, or other suitable connectors.

In one or more embodiments, the weight of the sample container 216 or the force applied against the sample container 216 may provide enough force to connect or otherwise engage the first connector 220 and the second connector 222. In one non-limiting embodiment the first connector 220 may be threaded into the second connector 222. In another non-limiting embodiment the second connector 222 may be threaded into the first connector 220. A motor or hydraulic actuator may be used to rotate the first connector 220, the second connector 222, or both to connect and disconnect the connectors.

In one or more embodiments, a fluid removal line may be in fluid communication with the mating section 214. The fluid removal line may be pumped using one or more pumps to remove drilling fluid, or other fluid used to convey the sample container 216 to the mating section 214. The fluid removal line may introduce at least a portion of any fluid within the mating section 214 to the path 210, the borehole, or other suitable location.

In one or more embodiments, a downhole sample may be introduced via line 205 from a downhole tool sample container 244 to the sample container 216. For a fluid downhole sample a pump or other fluid motive device may be used to introduce the fluid downhole sample to the sample container 216. For a solid downhole sample, for example a core sample, a mechanical rod or other device may be used to push or pull the sample toward and into the sample container 216.

After the downhole sample is introduced to the sample container 216 the sample container may be disconnected from the downhole tool 236. The sample container 216 may include a temperature adjuster to maintain the downhole sample at downhole conditions while the sample container 216 is retrieved. After retrieval of the sample container 216 the temperature adjuster may continue to operate until at least one downhole sample property can be estimated. In one or more embodiments, the sample container 216 may include a valve for releasing a fluid within the sample container 216. In another non-limiting embodiment the sample container 216 may include a valve for introducing a fluid to the sample container 216 to increase the pressure within the sample container.

Figure 3:
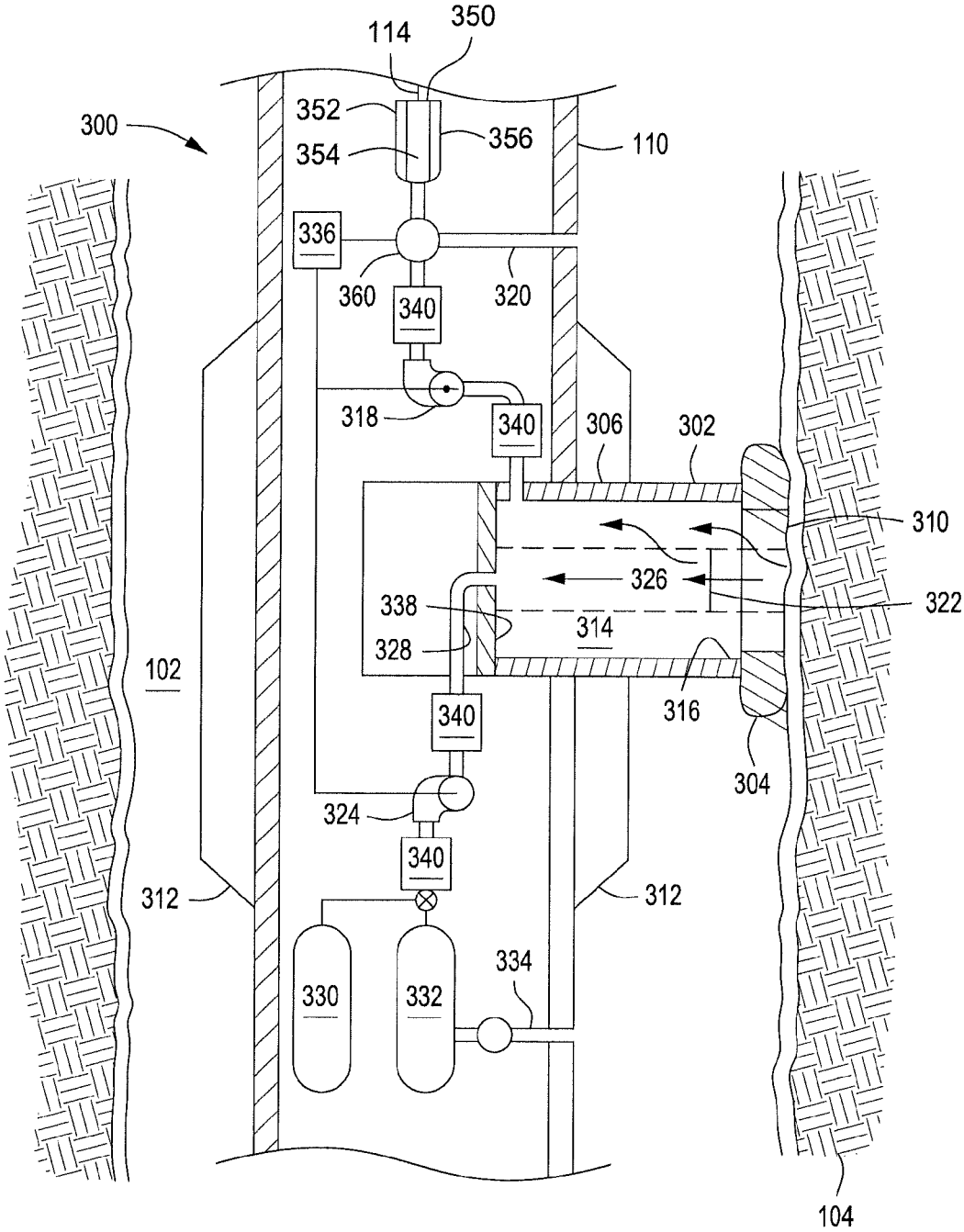
FIG. 3 is an elevation view that illustrates a non-limiting example of a downhole sub according to the disclosure.

FIG. 3 is an elevation view that illustrates a non-limiting example of a downhole sub 300 according to the disclosure. In one non-limiting embodiment the downhole sub 300 may include a fluid sampling probe 302 having a durable rubber pad 304 at a distal end of a probe body 306. The pad 304 may be mechanically pressed against the inner wall or borehole wall 308 of the borehole 102 adjacent a formation 104 hard enough to form a hydraulic seal between the borehole wall 308 and probe 302. The pad 304 includes an opening or port 310 leading to a chamber or cavity 314 formed by an inner wall 316 of the probe body 306. The pad 304 need not be rubber and may be constructed of any suitable material for forming a hydraulic seal. In some cases, the pad 304 may be eliminated and the probe end may form a seal with the borehole wall 308. The downhole sub 300 may also include a sample container 350 that may be conveyed to the fluid sampling probe 302 via a slickline 114 as discussed above and shown in FIGS. 1 and 2. In one or more embodiments, the fluid sampling probe 302 and the sample container 350 may be substantially as described above and shown in FIGS. 1 and 2.

In one or more embodiments, the sample container 350 may include a processor 352, sample holder 354, and operation equipment 356. The processor 352 may be used to direct or otherwise control operation of the sample container 350 while in-situ. The sample holder 354 may include a volume within the sample container 350 in which one or more downhole samples may be introduced and stored. Illustrative containers may include, but are not limited to one or more tanks, bottles, compartments, or other downhole sample storing devices. The operation equipment 356 may include, but is not limited to a temperature adjuster, a pressure controller, a motor, an electrical power supply, monitoring systems, and the like for performing operational functions, for example connecting the sample container 350 to the fluid sampling probe 302 and for controlling the sample container during retrieval from the downhole tool.

In one or more embodiments, a pump 318 and/or 324 may be used to reduce pressure within the cavity 314 to urge formation fluid into the port 310 and cavity 314. A flow line 320 in fluid communication with pump 318 via valve 360 may be used to convey fluid from a flow path within the cavity 314 to the borehole 102. A flow line 328 in fluid communication with pump 324 may be used to convey fluid from a flow path within the cavity 314 to the borehole 102. In one non-limiting example, a fluid test and/or analysis device 340 may be used to determine type and content of fluid flowing in the flow line 320 and/or 328. The fluid test device 340 may be located on either side of the pumps 318, 324 or as shown, on both the inlet and outlet of the pumps 318, 324 as desired. In several non-limiting embodiments fluid from cavity may be pumped continuously, intermittently, or a combination thereof.

In one non-limiting example, a sleeve-like member, or simply sleeve 322 is disposed within the cavity 314 and is in fluid communication with fluid entering the cavity 314. In non-limiting embodiment shown in FIG. 3, pump 324 may be used to control fluid pressure within the sleeve 322 and pump 318 may be used to control fluid pressure within the annulus between the sleeve 322 and the inner wall 316 of the probe body 306.

A flow path 326 within the sleeve allows fluid to be conveyed from the flow path 326 through flow line 328, which may lead to a sampling chamber 330, to test chamber 332, and/or to a dump line 334 leading back to the borehole 102. As used herein, the term sleeve means a member having a length, an outer cross-section perimeter and an inner cross-section perimeter creating a volume within the member. In the example of a cylindrical sleeve, the outer cross-section perimeter may be referred to as an outer diameter ("OD") and the inner cross-section perimeter may be referred to as an inner diameter ("ID"). The term sleeve however, includes any useful cross-section shaped member that may not be circular as in the case of a cylinder, but may include shapes including eccentric. In one non-limiting example, a fluid test device and/or analysis 340 may be used to determine type and content of fluid flowing in the flow line 328. The fluid test device 340 may be located on either side of the pump 324, or as shown, on both the inlet and outlet of the pump 324 as desired.

Each of the pumps 318, 324 may be independently controlled by one or more surface controllers, or by one or more downhole controllers 336, as shown. Fluid flow in the probe 302 according to several embodiments is controlled by controlling the flow rate in the cavity 314, the flow path 326, or both the cavity 314 and flow path 326 such that direction of fluid flowing in the cavity and the flow path may be controlled with respect to one another. In some cases, a flow rate may be selected for the cavity area and/or the flow path that urges at least some fluid flow from the flow path 326 to flow to the cavity 314 and to pump 318. In other cases, a flow rate may be selected for the cavity area and/or the flow path 326 that urges at least some fluid flow from the cavity 314 to the flow path 326 and to pump 324 for testing and/or storage.

In operation, the pump 318 may be used during initial sampling to generate a flow rate in the chamber flow path that is greater than the flow rate in the sleeve flow path 326 to help remove borehole fluid that may flow past the pad 310 seal. Once the fluid is relatively free of contamination by borehole fluid, the rate of pump 318 may be reduced or stopped to allow all or most of the clean fluid to be pumped by the pump 324. In several non-limiting embodiements the pump 324 may be used during initial sampling to generate a flow rate in the sleeve flow path 326 that is greater than the flow rate in the chamber flow path to help remove borehole fluid that may flow past the pad 310 seal. Once the fluid is relatively free of contamination by borehole fluid or other contaminating substances, the rate of pump 324 may be reduced or stopped to allow all or most of the clean fluid to be pumped by pump 318. This embodiment can provide a clean downhole fluid sample for introduction to the sample container 350.

In several non-limiting examples, the pump 318 and pump 324 may be controlled to generate different flow rates. Generating different flow rates in the respective sleeve and cavity portion surrounding the sleeve will create a pressure gradient between the sleeve flow path and the cavity portion surrounding the flow path. The pressure gradient may have a vector of varying direction and magnitude, and the direction of pressure gradient may be generally from the cavity to the flow path or the gradient direction may be generally from the flow path to the cavity depending on the flow rates in the respective areas.

In the non-limiting example of FIG. 3, the probe 302 is shown mounted on the downhole sub 110 at a centralizer 312. A centralizer is a member, usually metal, extending radially from the downhole sub 110 to help keep the downhole sub 110 centered within the borehole 102. Other configurations of downhole tools may use ribs as centralizers or no centralizer at all. In some cases, a back-up shoe may be used to provide a counter force to help keep a probe pad 304 pressed against the borehole wall 308. In other cases one or more packers may be used to position the downhole system 300 within the borehole 102.

The probe 302 may be coupled to the downhole sub 110 in a controllably extendable manner, such as is known in the art. In another example, the probe 302 may be mounted in a fixed position with an extendable rib or centralizer used to move the pad 304 toward the wall 304.

The inner sleeve-like member 322 may be of any number of sleeve types to allow fluid communication between the sleeve flow path 326 and cavity 314. In one example, the sleeve may be a solid cylinder-shaped sleeve that extends from a rear section 338 of the probe 302 toward the pad 304 port 310 and terminating in the cavity without extending all the way to the borehole wall 308. In this manner, fluid communication between the sleeve flow path and cavity is concentrated substantially near the sleeve terminating end within the cavity. In another non-limiting example, the sleeve-like member 322 may include several openings along the length of the sleeve or the front portion of the sleeve 322 to allow fluid communication between the sleeve flow path 326 and the cavity 314 as shown by the arrow extending from the flow path 326 to the cavity 314 in FIG. 3. In several embodiments including openings along the sleeve, the sleeve 322 may either terminate within the cavity 314 or the sleeve may extend to the borehole wall 308.

Figure 4:
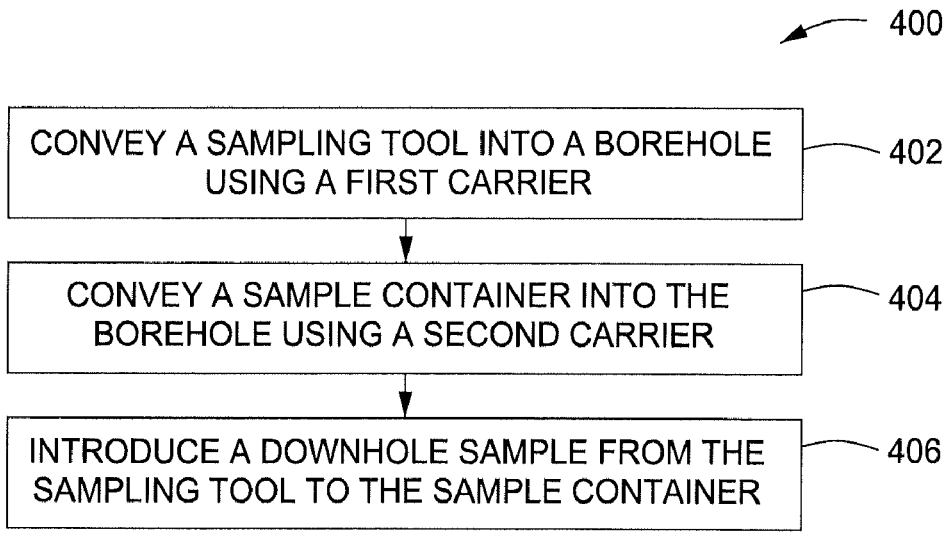
FIG. 4 illustrates one example of a non-limiting method for collecting a downhole sample according to the disclosure.

FIG. 4 illustrates one example of a non-limiting method 400 for collecting a downhole sample according to the disclosure. The method 400 includes conveying a sampling tool into a borehole using a first carrier 402. The sampling tool may be substantially similar to the downhole tools discussed above and shown in FIGS. 1-3. The method 400 may further include conveying a sample container into the borehole using a second carrier 404. The sample container may be substantially similar to the sample containers discussed above and shown in FIGS. 1-3. The method 400 may also include introducing a downhole sample from the sampling tool to the sample container. In several non-limiting embodiments the downhole sample may be a solid, liquid, gas, or any combination thereof In at least one non-limiting embodiment the method 400 may include conveying the sample container into the borehole after the sampling tool reaches a predetermined position within the borehole. In one-non limiting embodiment conveying the sample container using the second carrier may include conveying the second carrier within the first carrier. In several non-limiting embodiments the method 400 may further include retrieving the sample container. In one or more embodiments, the method 400 may include controlling at least one of a temperature, a pressure, and a phase of the downhole sample introduced to the sample container during retrieval, after retrieval, or both. For example, the temperature of the downhole sample may be maintained within a predetermined range of the temperature of the downhole sample when it was recovered by the sampling tool and/or introduced to the sample container.

Figure 5:
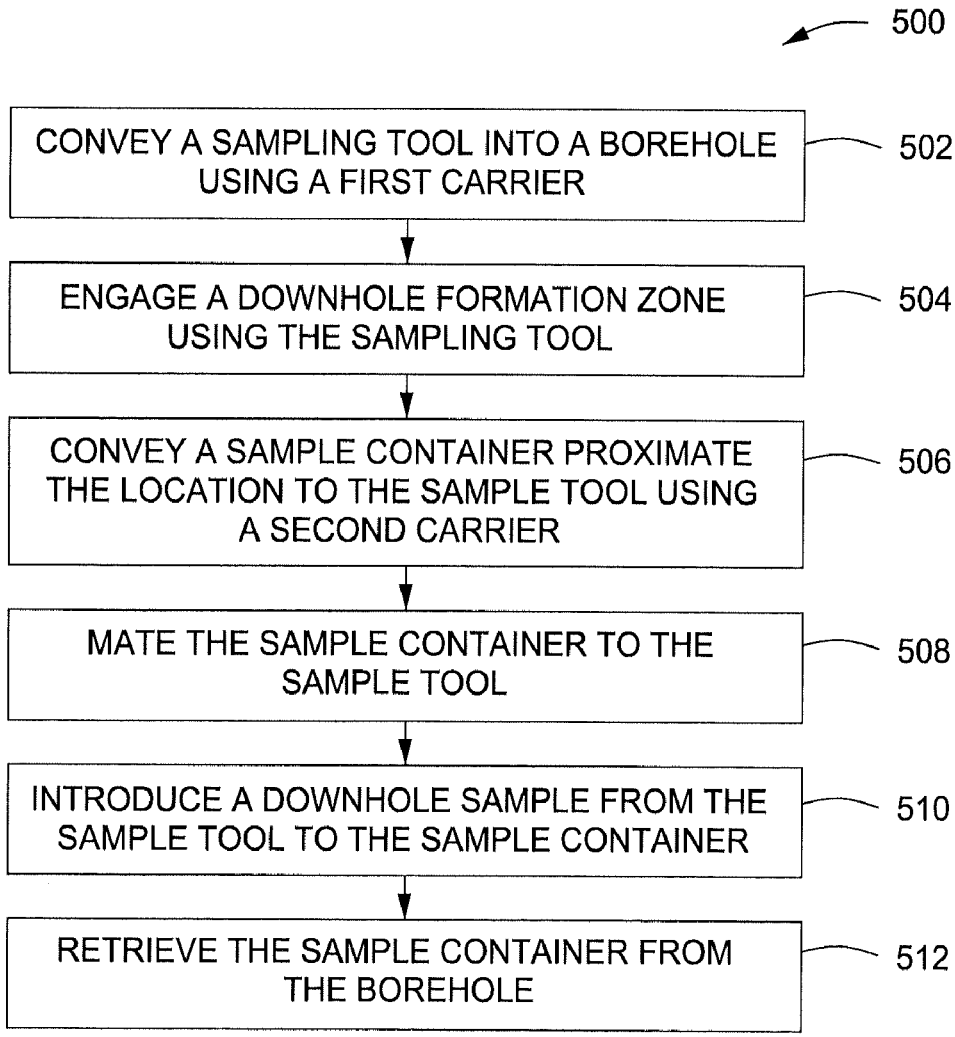
FIG. 5 illustrates another example of a non-limiting method for collecting a downhole sample according to the disclosure.

FIG. 5 illustrates another example of a non-limiting method 500 for collecting a downhole sample according to the disclosure. The method 500 includes conveying a sampling tool into a borehole using a first carrier 502. The sampling tool may be substantially similar to the downhole tools discussed above and shown in FIGS. 1-3. The method 500 may further include engaging a downhole formation zone using the sampling tool 504. The method 500 also includes conveying a sample container proximate the location of the sample tool using a second carrier 506. In one-non limiting embodiment conveying the sample container using the second carrier may include conveying the second carrier within the first carrier. In several non-limiting embodiments the sample container may be conveyed into the borehole before, during, and/or after the sampling tool engages the downhole formation zone. The method 500 may also include mating the sample container to the sample tool 508. Mating the sample container to the sample tool may be performed before, during, and/or after the sampling tool engages the sample tool. The method 500 may also include introducing a downhole sample from the sample tool to the sample container 510. In several non-limiting embodiments the method 500 may also include retrieving the sample container from the borehole 512. In one or more embodiments the method 500 may include controlling at least one of a temperature, a pressure, and a phase of the downhole sample introduced to the sample container during retrieval, after retrieval, or both. For example, the temperature of the downhole sample may be maintained within a predetermined range of the temperature of the downhole sample when it was recovered by the sampling tool and/or introduced to the sample container.

The present disclosure is to be taken as illustrative rather than as limiting the scope or nature of the claims below. Numerous modifications and variations will become apparent to those skilled in the art after studying the disclosure, including use of equivalent functional and/or structural substitutes for elements described herein, use of equivalent functional couplings for couplings described herein, and/or use of equivalent functional actions for actions described herein. Such insubstantial variations are to be considered within the scope of the claims below.

Given the above disclosure of general concepts and specific embodiments, the scope of protection is defined by the claims appended hereto. The issued claims are not to be taken as limiting Applicant's right to claim disclosed, but not yet literally claimed subject matter by way of one or more further applications including those filed pursuant to the laws of the United States and/or international treaty.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

What is claimed is:

1. A method for collecting a downhole fluid sample comprising:

conveying a sampling tool in a borehole using a first carrier;

conveying a fluid sample container in the borehole using a second carrier; and introducing a downhole fluid sample from the sampling tool to the fluid sample container;

wherein conveying the fluid sample container includes pumping the sample container in a drilling fluid flow line.

2. The method of claim 1, wherein the fluid sample container is conveyed into the borehole after the sampling tool reaches a predetermined position within the borehole.

3. The method of claim 1, wherein the second carrier includes a slickline.

4. The method of claim 1, wherein conveying the second carrier into the borehole includes conveying the second carrier within the first carrier.

5. The method of claim 1, further comprising retrieving the fluid sample container.

6. The method of claim 5, further comprising controlling at least one of a temperature, a pressure, and a phase of the downhole fluid sample during retrieval.

7. A method for collecting a downhole sample comprising:

conveying a sampling tool in a borehole using a first carrier;

engaging a downhole formation zone using the sampling tool;

conveying a sample container proximate the location of the sample tool using a second carrier;

mating the sample container to the sample tool;

introducing a downhole sample from the sample tool to the sample container; and retrieving the sample container from the borehole;

wherein conveying the sample container includes pumping the sample container in a drilling fluid flow line.

8. The method of claim 7, wherein the sample container is conveyed into the borehole after the sampling tool reaches a predetermined position within the borehole.

9. The method of claim 7, wherein the second carrier includes a slickline.

10. The method of claim 7, wherein conveying the second carrier into the borehole includes conveying the second carrier within the first carrier.

11. The method of claim 7, further comprising controlling at least one of a temperature, a pressure, and a phase of the downhole sample introduced to the sample container.

12. An apparatus for collecting a downhole sample comprising:

a sampling tool disposed on a first carrier;

a fluid sample container disposed on a second carrier, wherein the first carrier and the second carrier are independently conveyable in a borehole;

a coupling connectable to the sampling tool and the fluid sample container; and a pump configured for pumping the sample container in a drilling fluid flow line.

13. The apparatus of claim 12, wherein the coupling provides fluid communication between the sampling tool and the fluid sample container.

14. The apparatus of claim 12, wherein the first carrier includes a rotatable drill pipe, a coiled tube, or a wireline.

15. The apparatus of claim 12, wherein the second carrier includes a slickline.

16. The apparatus of claim 12, wherein the second carrier is conveyable within the first carrier.

17. The apparatus of claim 12, wherein the second carrier includes a heater.

18. The apparatus of claim 12, wherein the second carrier is conveyable into the borehole after the first carrier.

* * * * *